United States Patent [19]

Sakamaki et al.

[11] Patent Number: 4,997,351

[45] Date of Patent: Mar. 5, 1991

[54] ROTARY MACHINE HAVING VANES WITH EMBEDDED REINFORCEMENT

[75] Inventors: Hiroshi Sakamaki; Yukio Horikoshi; Takeshi Jinnouchi; Kenji Tanzawa, all of Sakado, Japan

[73] Assignee: Eagle Industry Co., Ltd., Tokyo, Japan

[21] Appl. No.: 394,774

[22] Filed: Aug. 16, 1989

Related U.S. Application Data

[60] Division of Ser. No. 197,548, May 23, 1988, Pat. No. 4,958,995, which is a continuation-in-part of Ser. No. 75,006, Jul. 17, 1987, abandoned, Ser. No. 110,919, Oct. 21, 1987, abandoned, Ser. No. 113,568, Oct. 26, 1989, abandoned, and Ser. No. 115,677, Oct. 30, 1987, abandoned.

[30] Foreign Application Priority Data

| | | | |
|---|---|---|---|
| Jul. 22, 1986 | [JP] | Japan | 61-170903 |
| Jul. 22, 1986 | [JP] | Japan | 61-111490[U] |
| Oct. 4, 1986 | [JP] | Japan | 61-168145[U] |
| Oct. 23, 1986 | [JP] | Japan | 61-161609[U] |
| Nov. 4, 1986 | [JP] | Japan | 61-168147[U] |
| Nov. 14, 1986 | [JP] | Japan | 61-269961 |
| Nov. 14, 1986 | [JP] | Japan | 61-269960[U] |
| Nov. 17, 1986 | [JP] | Japan | 61-271934 |
| Nov. 21, 1986 | [JP] | Japan | 61-178287[U] |
| Nov. 21, 1986 | [JP] | Japan | 61-178288[U] |
| Nov. 21, 1986 | [JP] | Japan | 61-276690 |
| Nov. 21, 1986 | [JP] | Japan | 61-276689 |
| Nov. 23, 1986 | [JP] | Japan | 61-161610[U] |
| Dec. 3, 1986 | [JP] | Japan | 61-185571[U] |

[51] Int. Cl.[5] ..... F01C 1/344

[52] U.S. Cl. ..... 418/152; 418/257; 418/265

[58] Field of Search ..... 418/152, 256, 257, 260, 418/261, 264, 265

[56] References Cited

U.S. PATENT DOCUMENTS

| | | | |
|---|---|---|---|
| 1,444,269 | 2/1923 | Piatt | 418/257 |
| 1,669,779 | 5/1928 | Reavell | 418/265 |
| 2,672,282 | 3/1954 | Novas | 418/152 |
| 3,485,179 | 12/1969 | Dawes | 418/152 |
| 3,990,239 | 11/1976 | Pattas et al. | 60/519 |
| 4,144,003 | 3/1979 | Berkowitz | 418/152 |
| 4,184,821 | 1/1980 | Smolinski et al. | 418/152 |
| 4,209,286 | 6/1980 | Schwartz | 418/260 |

FOREIGN PATENT DOCUMENTS

| | | | |
|---|---|---|---|
| 2458675 | 2/1981 | France | 418/264 |
| 54-5207 | 1/1979 | Japan | 418/265 |

*Primary Examiner*—John J. Vrablik

*Attorney, Agent, or Firm*—Jordan and Hamburg

[57] ABSTRACT

A vane pump in which a projection is provided on the end of a vane which radially slides as a rotor rotates, and an annular race concentric with an inner peripheral surface of a housing is provided in the inner surface of the end wall of the housing, the projection being brought into engagement with the annular race to control the slide of the vane.

21 Claims, 8 Drawing Sheets

ROTARY MACHINE HAVING VANES WITH EMBEDDED REINFORCEMENT

RELATED APPLICATIONS

This is a division application of U.S. Ser. No. 197,548, filed May 23, 1988, now U.S. Pat. No. 4,958,995, which is a continuation-in-part application of U.S. Ser. No. 075,006 filed July 17, 1987, abandoned; U.S. Ser. No. 110,919 filed Oct. 21, 1987, abandoned; U.S. Ser. No. 113,568 filed Oct. 26, 1987, abandoned; and U.S. Ser. No. 115,677 filed Oct. 30, 1987, abandoned.

BACKGROUND OF THE INVENTION

The present invention relates to a vane pump which is one of rotary pumps used for various kinds of apparatuses such as a supercharger of an engine, a compressor of a freezing cycle, and the like.

A vane pump schematically shown in FIG. 17 has been heretofore widely known.

In FIG. 17, reference numeral 101 designates a housing; 102, a rotor inserted eccentrically into an inner peripheral space of the housing 101 and rotatably supported by a rotational shaft 103; 105*a*, 105*b* and 105*c*, plate-like vanes disposed radially retractably from vane grooves 104*a*, 104*b* and 104*c* equally spaced apart so as to peripherally divide the outer peripheral side of the rotor 102 into three sections. When the rotor 102 is rotated in the direction as indicated by the arrow X by the rotational shaft 103, the vanes 105*a*, 105*b* and 105*c* are moved out in the direction of the outside diameter by the centrifugal force, and the end edges thereof rotate while slidably contacting the inner peripheral surface of the housing 101. Since the rotor 102 is eccentric with respect to the housing 101 as previously mentioned, as such rotation occurs, volumes of working spaces 106*a*, 106*b* and 106*c* defined by the housing 101, the rotor 102 and the vanes 105*a*, 105*b* and 105*c* are repeatedly enlarged and contracted to allow a fluid taken in from an intake port 107 to be discharged out of an outlet port 108.

However, the above-described conventional vane pump has problems that since the vanes slidably move along the inner peripheral surface of the housing at high speeds, the efficiency of the volume caused by the great power loss due to the sliding resistance and by the generation of high sliding heat unavoidably deteriorates; the vanes materially become worn; and the vanes are expanded due to the generation of sliding heat to produce a galling with the inner side surfaces of both end walls of the housing, and the like.

In view of these problems as noted above, it is an object of the present invention to enhance the efficiency of such a pump and enhance the durability thereof.

SUMMARY OF THE INVENTION

To achieve the aforementioned objects, a vane pump according to the present invention is characterized in that projections such as pins are provided on both ends of a vane, and an annular race in peripheral slidable engagement with the projections to define the protrusion of the vane from a vane groove is formed coaxially with the inner peripheral surface of the housing.

According to the present invention, the protrusion of the vane from the vane groove is not defined by the contact thereof with the inner peripheral surface of the housing, but it is defined in a manner such that the end edge of the vane depicts a certain locus by the engagement of the projections such as pins provided on the vane with the annular race formed on the side of the housing. The vane may be rotated in the state in which the vane is not in contact with the inner surface of the housing, and therefore, the present invention has excellent advantages which can prevent the deterioration of the efficiency of the pump caused by the sliding resistance and the wear of the vane; and which can prevent occurrence of inconvenience resulting from an increase in sliding heat.

According to the present invention, the protrusion of the vanes from the vane grooves is not defined by the contact with the inner peripheral surface of the housing but it is defined so that the end edges of the vanes depict a given locus by engagement of the retainer plates fitted in the housing with the vanes through the cams. The vanes can be rotated in a state not in contact with the inner surface of the housing. Therefore, the present invention has excellent effects in that the lowering of the rotational efficiency and the wear of the vanes due to the sliding resistance can be prevented, and the occurrence of inconvenience such as the lowering of the volume efficiency due to the increase in heat generation caused by sliding can also be prevented.

While the present invention has been briefly outlined, the above and other objects and new features of the present invention will be fully understood from the reading of the ensuing detailed description in conjunction with embodiments shown in the accompanying drawings. It is to be noted that the drawings are exclusively used to show certain embodiments for the understanding of the present invention and are not intended to limit the scope of this invention.

DESCRIPTION OF THE PREFERRED EMBODIMENTS

A fundamental exemplification of a vane pump according to the present invention will now be described with reference to FIGS. 1 to 3.

Figure 1:
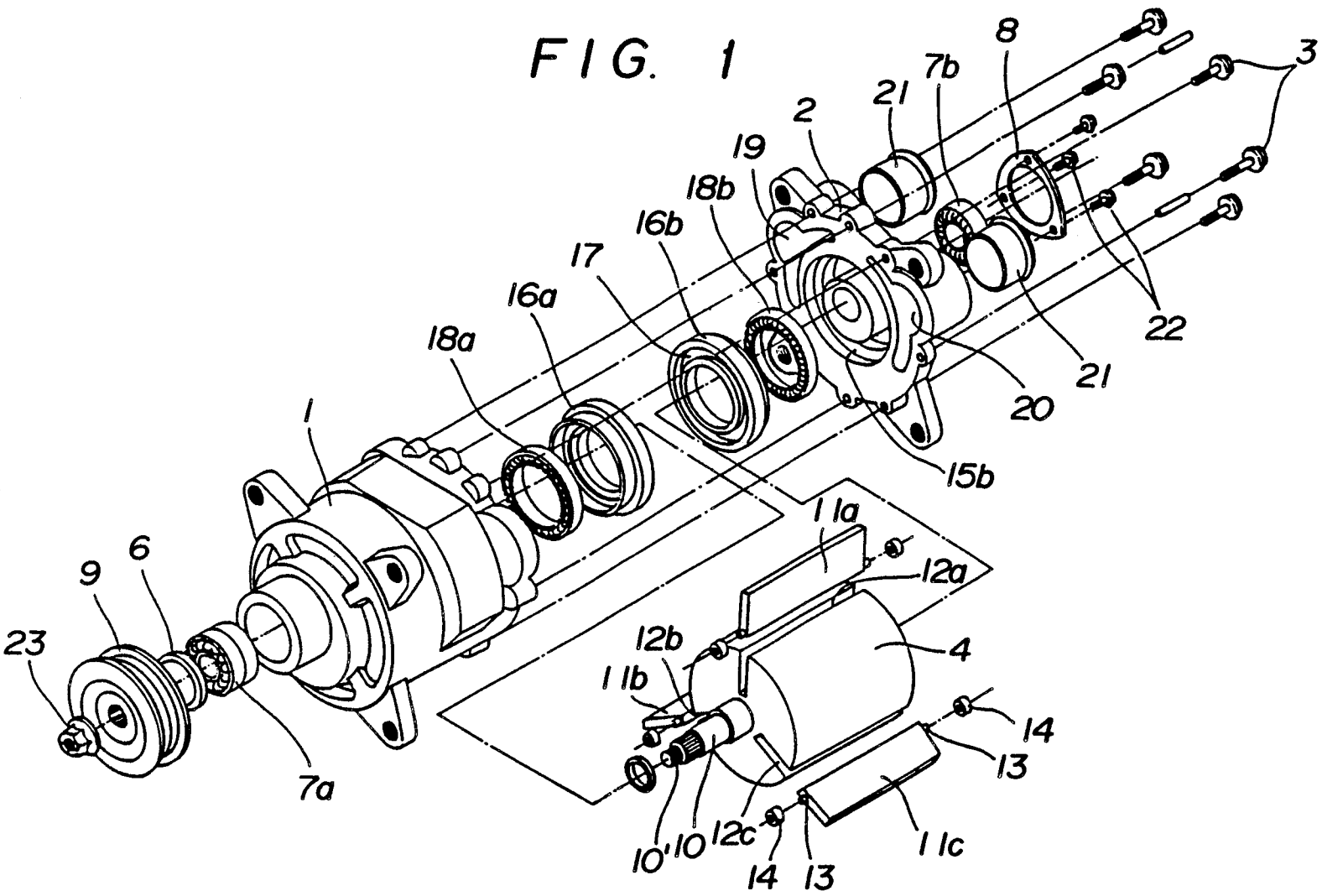
FIG. 1 is an exploded perspective view of a vane pump according to a fundamental embodiment of the present invention.
Figure 2:
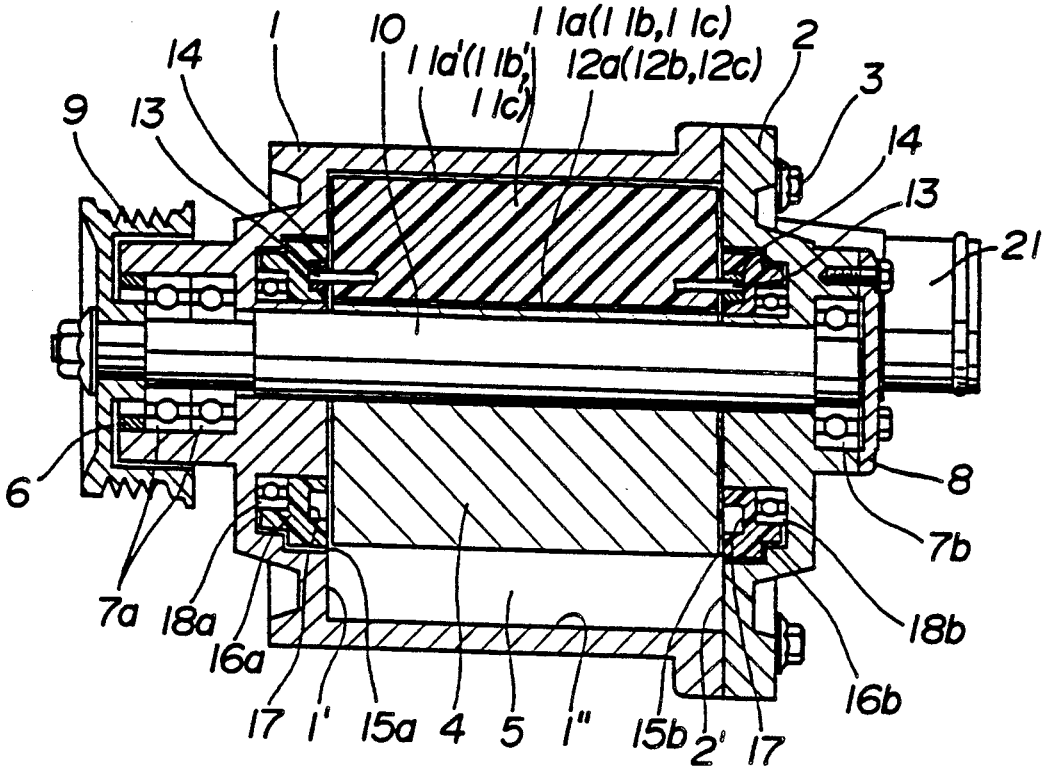
FIG. 2 is a sectional view showing the pump of FIG. 1 assembled.
Figure 3:
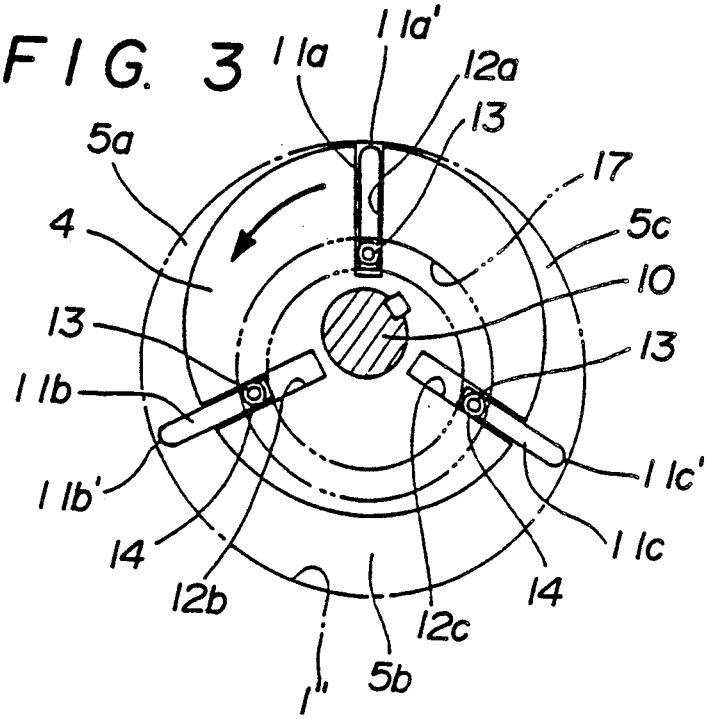
FIG. 3 is a side view of a rotor of the same pump of FIG. 1.

In FIGS. 1 and 2, a front housing 1 and a rear housing 2, both of which housings are made of non-ferrous metal such as aluminum, which is light in weight and is small in the coefficient of thermal expansion, are secured integral with each other by means of bolts 3. A rotor 4 made of iron eccentrically inserted into an inner peripheral space 5 of the housing is extended through both the housings 1 and 2 through a ball bearing 7a held by a fixed ring 6 in anti-slipout fashion in an axial shoulder of the front housing 1 and a ball bearing 7b held by a bearing cover 8 in anti-slipout fashion in an axial shoulder of the rear housing 2 and is rotatably mounted on a rotational shaft 10 to which a drive force is transmitted from a pulley 9. Plate-like vanes 11a, 11b and 11c principally made of a carbon material having an excellent slidability are disposed to be radially projected and retracted in vane grooves 12a, 12b and 12c, respectively, which are formed in the form of depressions equally spaced apart so as to peripherally divide the outer peripheral side of the rotor 4 into three sections, on the rotor 4. On opposite ends of each of the vanes 11a, 11b and 11c corresponding to axial opposite sides of the rotor 4 are projected steel pins 13 and 13, respectively, and a sleeve bearing 14 made of resin having excellent slidability and abrasion resistance is slipped over each of pins 13. In annular recesses 15a and 15b formed in inner surfaces 1' and 2' of end walls where the front housing 1 and the rear housing 2 are opposed to each other coaxial with the inner peripheral space 5 of the housing (coaxial with the inner peripheral surface 1'' of the front housing 1), retainer rings 16a and 16b made of non-ferrous metal such as aluminum and each having an annular race 17 are rotatably fitted through ball bearings 18a and 18b, respectively. The pins 13 and 13 projected on the respective vanes 11a, 11b and 11c peripherally slidably engage the annular races 17 and 17 of the retainer rings 16a and 16b through the respective sleeve bearings 14. This engagement defines the radial movement of the vanes 11a, 11b and 11c during rotation so as to maintain a state in which there is formed a slight clearance between the end edges 11a', 11b' and 11c' (see FIG. 3) thereof and the inner peripheral surface 1'' of the front housing 1. An intake port 19 for guiding a fluid into the inner peripheral space 5 of the housing from the exterior of the pump and an outlet port 20 for guiding a fluid to the exterior from the inner peripheral space 5 of the housing are formed in the rear housing 2. Reference numerals 21, 21 designate tubes mounted on the intake port 19 and outlet port 20, respectively; 22 a bolt used to secure the bearing cover 8 to the rear housing 2; and 23, a nut in engagement with an external thread 10' of the end of the rotational shaft 10 in order to secure the pulley 9 to the rotational shaft 10.

The operation of the above-described vane pump will be described hereinafter. When the rotational shaft 10 and rotor 4 are rotated by the drive force from the pulley 9, the vanes 11a, 11b and 11c also rotate, and the pins 13 and 13 projected on the vanes 11a, 11b and 11c, respectively, and the sleeve bearings 14 and 14 slipped over the pins 13 and 13 rotate along the annular races 17 and 17. Since as shown in FIG. 3, the inner peripheral surface 1'' of the housing and the annular race 17 are in coaxial relation and the annular race 17 and the rotor 4 are in eccentric relation, the vanes 11a, 11b and 11c are radially slidably moved in the vane grooves 12a, 12b and 12c of the rotor 4 to be projected and retracted repeatedly with the result that the volumes of the working spaces 5a, 5b and 5c defined by both the housings 1, 2, the rotor 4 and the vanes 11a, 11b and 11c repeatedly increase and decrease. That is, in FIG. 3, the working space 5a, with the rotation, increases its volume to such the fluid from the intake port 19 (not shown; see FIG. 1) opening to portion 5a; the working space 5c, with the rotation, decreases its volume to discharge the fluid into the outlet port 20 (not shown; see FIG. 1) opening to portion 5c; and the working space 5b transfers the thus sucked fluid toward the outlet port 20. In the above-described operation, the end edges 11a', 11b' and 11c' of the vanes 11a, 11b and 11c are not in sliding contact with the inner peripheral surface 1'' of the front housing, as previously mentioned, and therefore, abrasion or high heat hardly occurs. In addition, the sleeve bearing 14 slipped over the pin 13 is slidably rotated while being pressed against the outside diameter side by the centrifugal force within the annular race 17 of the retainer rings 16a and 16b while the retainer rings 16a and 16b follow the sleeve bearing 14 for rotation because the former are in the state to be rotatable by the ball bearings 18a and 18b, respectively. The relative sliding speed between the sleeve bearing 14 and the annular race 17 is low whereby the abrasions of annular race 17, retainer rings 16a and 16b, the sleeve bearing 14 and the like can be minimized.

It is believed that the fundamental mode of the present invention is now fully understood from the above-described description. The pump of the first embodiment shown in FIGS. 1 to 3 constitutes, in a sense, the core of the variations described below.

Figure 4:
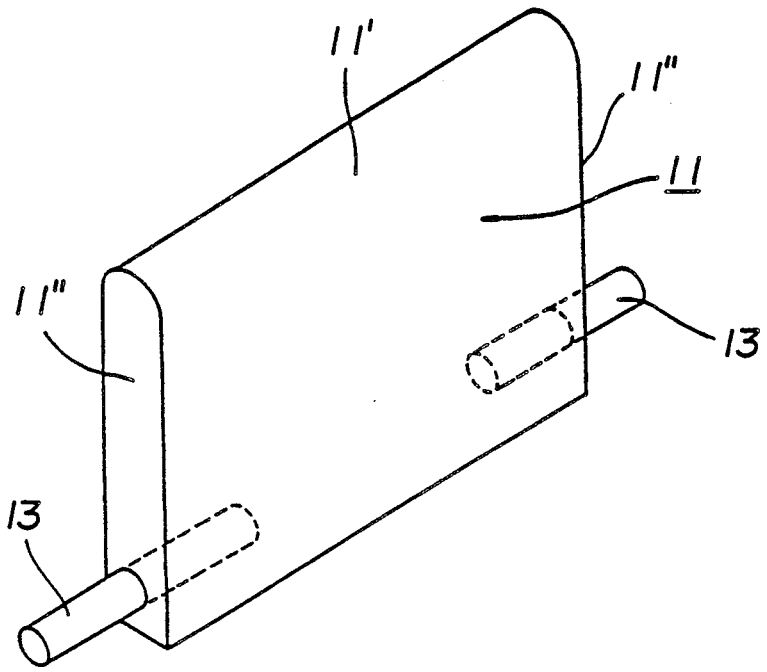
FIGS. 4, 5, 6 and 7 are perspective views of vanes, respectively.

FIG. 4 shows a mode different from the above-described first embodiment with respect to the technique in which projections are provided on the vane.

Figure 5:
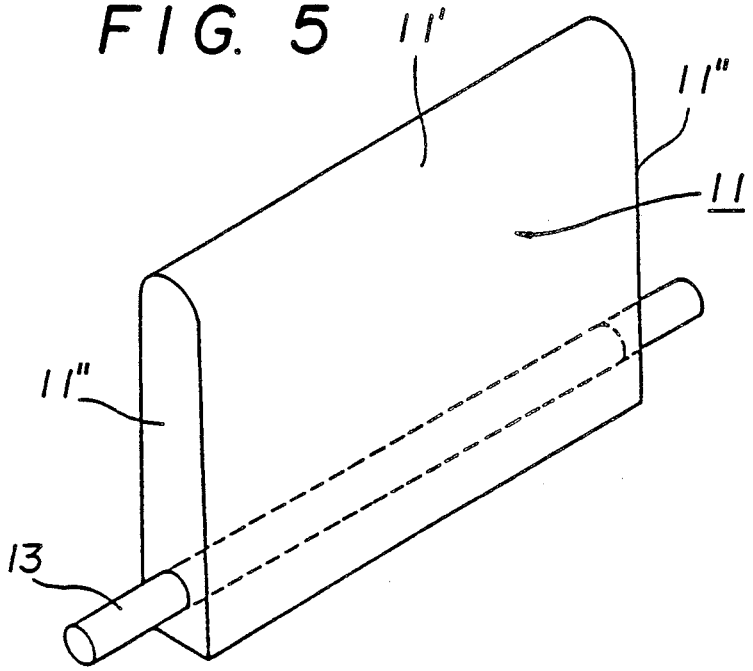
Figure 6:
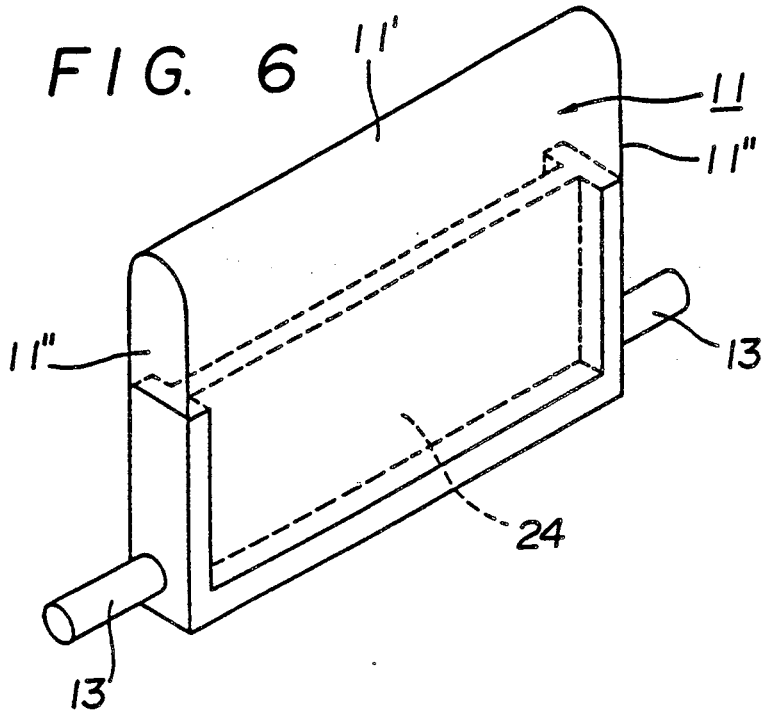
Figure 7:
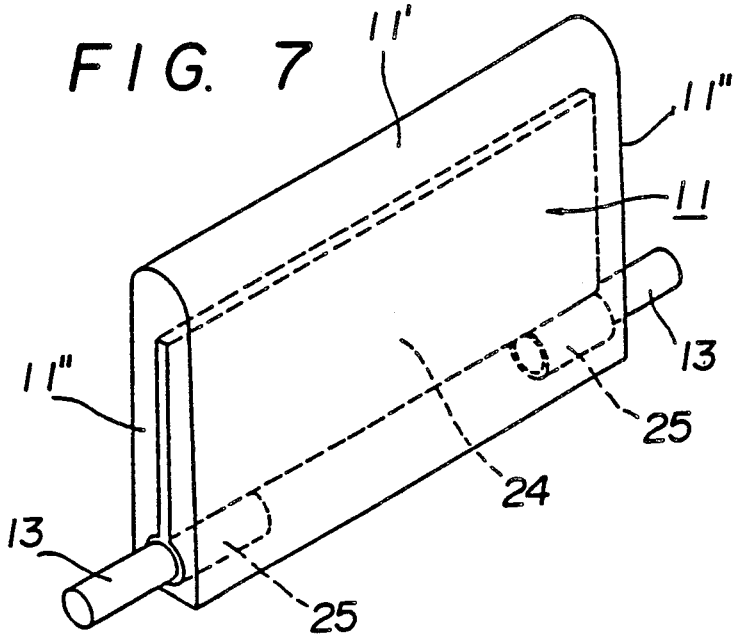

That is, in FIG. 4, cylindrical pins 13 made of iron or non-ferrous metal are embedded at positions one-sided on parts which form the inside diameter side in the state incorporated into the rotor 4 of opposite ends 11'' and 11'' of a plate-like vane 11 which is made of carbon or the like and in which end edges 11' which form the outside diameter side in the state incorporated into the rotor 4 are formed into an arc. Alternatively, as shown in FIG. 5, a lengthy pin 13 is extended through and secured to the vane 11, and opposite ends of the pin 13 are projected; as shown in FIG. 6, pins 13 and 13 are embedded into the vane 11 and integrally provided by welding or the like on opposite ends of a plate-like reinforcing member 24 made of iron or non-ferrous metal such as aluminum; or as shown in FIG. 7, pins 13 and 13 are housed in tubular bodies 25 and 25 formed on opposite ends of a reinforcing member 24.

Several modes of embodiments of the present invention variously elaborated on the basis of the design of the pump according to the aforementioned first embodiment shown in FIGS. 1 to 3 will be discussed below.

A vane pump belonging to the type 1 is characterized by having a vane wherein a vane body is coated with a nonlubricated sliding material using a metal plate having a required number of punched portions as a core, and projections are integrally secured to or integrally formed on the metal plate.

In the vane pump according to the aforementioned first embodiment, a great outward force caused by a centrifugal force exerts on the pin which is a projection to define the protrusion of the vane and the fixed portion between the pin and the vane, and therefore the strength of the fixed portion and the reduction in weight of the vane need be taken into consideration.

For this reason, an object of the aforesaid type 1 is to enhance the strength between the vane and the projection and reduce the weight of the vane.

In the vane of the pump belonging to this type 1, the projection is integral with the metal plate as the reinforcing core, and the base of the projection on the side of the metal plate is coated with non-lubricated sliding material, and therefore the strength is great. In addition, since the metal plate has the punched portions thus considerably reducing the weight, and the non-lubricated sliding materials on both sides of the metal plate are fused to each other through the punched portions, the strength of the vane body itself also increases.

One example of the vane belonging to the type 1 will be described below with reference to the drawings.

Figure 8:
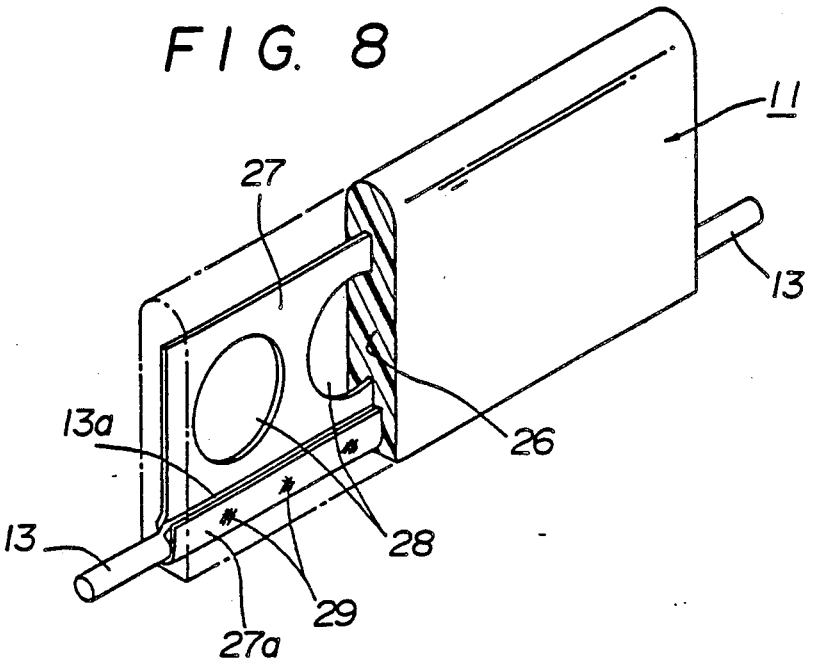
FIG. 8 is a perspective view, partly cutaway, of a vane of the pump belonging to Type 1.

Referring first to FIG. 8, reference numeral 11 designates a plate-like vane body coated with a non-lubricated sliding material 26 having excellent self-lubricating properties such as resins, molded carbon, etc. using a metal plate 27 made of steel or non-ferrous metal such as aluminum having a plurality of circular punched portions 28 as a core, and reference numeral 13 designates pins which are projections projected from opposite ends of the vane body 11. A base 13*a* of the pin 13 is caulked to one long side 27*a* of the metal plate 27 and is made integral with the metal plate 27 by applying spot welding at 29 to suitable points of the caulked portion.

Figure 9:
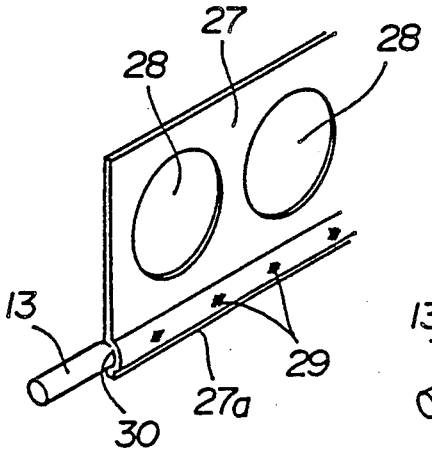
FIGS. 9, 10, 11, 12, 13 and 14 are respective perspective views of essential parts showing the internal construction of the vane belonging to the same Type 1.
Figure 10:
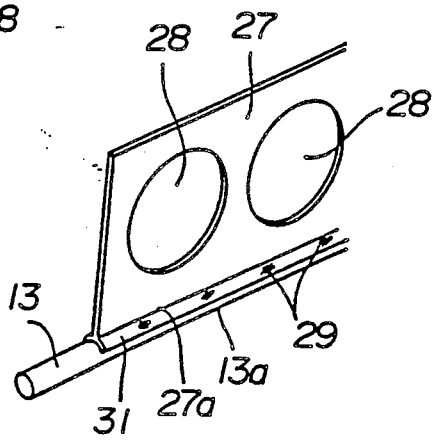
Figure 11:
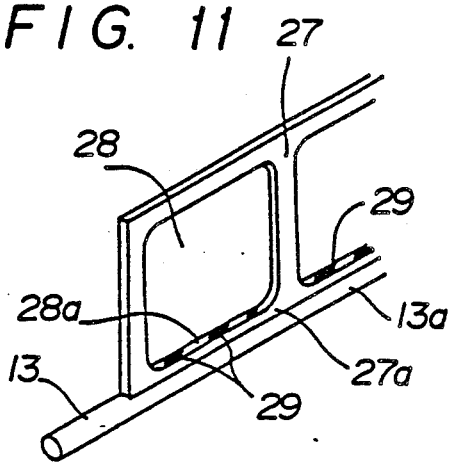
Figure 12:
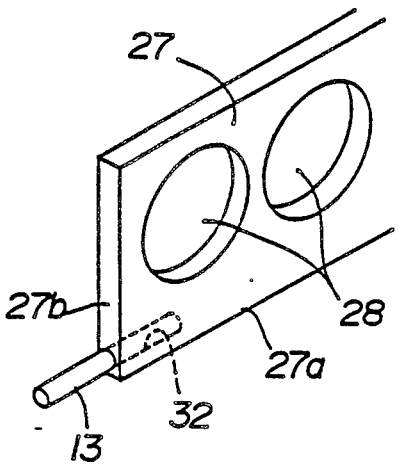

Modes of the fixed portion between the pin 13 and the metal plate 27 include an arrangement as shown in FIG. 9 in which a base (not shown) of a pin 13 is joined to a groove 30 formed in the vicinity of one long side 27*a* of the metal plate 27, and the base and the groove 30 are joined by spot welding at 29 at suitable points; an arrangement as shown in FIG. 10 in which a base 13*a* of a pin 13 is joined to a trough portion 31 formed integral with one long side 27*a* of a metal plate 27, and the base 13*a* and the trough portion 31 are joined by spot welding at 29 at suitable points; an arrangement as shown in FIG. 11 in which a punched portion 28 of a metal plate 27 is formed into a square, and one long side 27*a* of the metal plate 27 and a base 13*a* of a pin 13 are applied with spot welding at 29 from one edge 28*a* of the punched portion 28; and an arrangement as shown in FIG. 12 in which one long side 27*a* is interiorly formed with a pin receiving hole 32 from both ends 27*h* of a metal plate 27, and a pin 13 is hammered into the hole.

Figure 13:
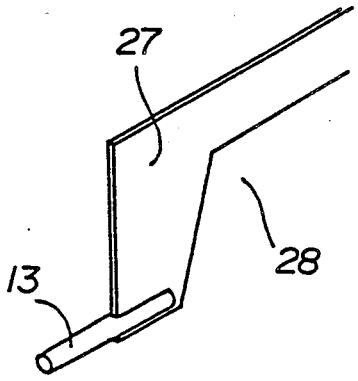
Figure 14:
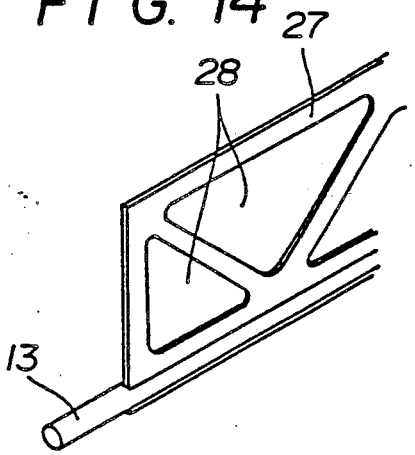

In addition, the pin 13 and the metal plate 27 may be integrally molded by molding means such as casting or forging as shown in FIGS. 13 and 14. The shape of the punched portion 28 has various modifications such as circular shapes as in FIGS. 8 to 10 and 12, a square shape as in FIG. 11, a cutout shape as in FIG. 13, and a triangular shape as in FIG. 14. Other shapes such as an oblong shape, a shape with a large number of pores, etc. may be used.

As described above, according to the vane for the pump described above, the supporting force against the protrusion of the vane during rotation by the projections on the opposite ends of the vane is strengthened, and therefore high-speed rotation becomes possible to enhance the feed force of the fluid under pressure. Accordingly, the pump may be miniaturized and reduced in weight. Furthermore, the metal plate serving as the core of the vane has the punched holes to suppress the increase in weight of the vane and the increase in the centrifugal force acting on the vane. Moreover, the non-lubricated sliding materials coated on both sides of the metal plate become fused to each other through the punched portions, and therefore the strength of the vane body itself also increases, thus providing a significant practical effect.

A vane pump belonging to this type 2 has a vane for a pump characterized in that a cavity such as a cutout is formed in the base of the vane, mounting holes are made coaxially to each other in sleeves which are located on opposite sides of the cavity in a longitudinal direction, and projections of a single pin are inserted into the mounting holes, respectively. An object of the type 2 is, likewise to type 1, to enhance the projections and the fixed portion between the projections and the vane.

In the vane of the pump belonging to the type 2, the projections on the opposite ends of the vane are in the form of a single rod, and therefore, there is no local stress concentrated on the fixed portion relative to the vane (the fitted portion to the mounting hole), and the supporting force against the protrusion of the vane is enhanced. In addition, since the mounting holes through which the pin extends are divided by the cavity, a drilling process may be executed with high accuracy as compared to the case in which a single mounting hole passing through and between the opposite ends of the vane is bored, and in addition, the weight of the vane is reduced through a portion of the cavity.

One example of the vane belonging to the type 2 will be described below with reference to the drawings.

Figure 15:
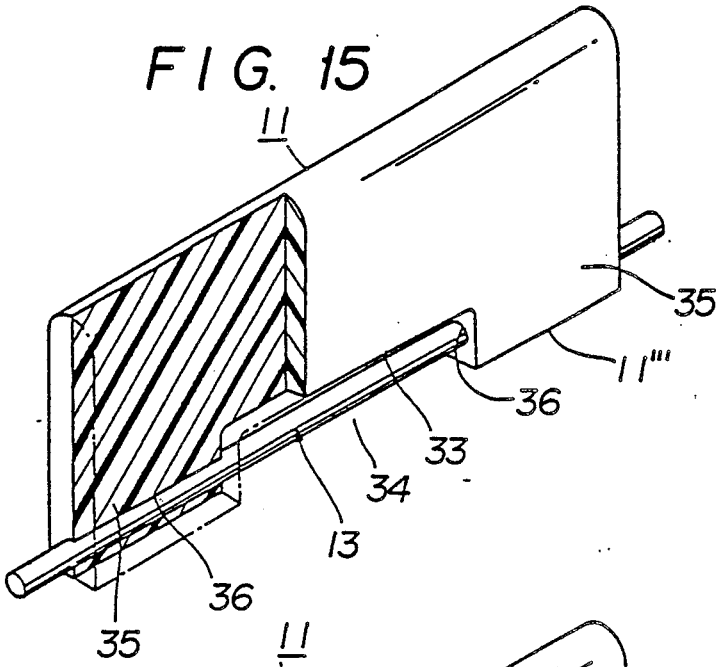
FIG. 15 is a perspective view, partly cutaway, of a vane of a pump belonging to Type 2.

First, in FIG. 15, a vane indicated at 11 is formed of a non-lubricated sliding material such as resin or molded carbon having excellent self lubricating properties, and a cutout 33 is made in the central portion of the base 11''' of the vane 11 to form a cavity 34. Mounting holes 36 are coaxially bored in sleeves 35 and 35, respectively, on opposite sides in a longitudinal direction of the cutout 33. Reference numeral 13 designates a single rod-like pin inserted into and secured in the mounting holes 36 and 36, and opposite ends of the pin 13 projecting from the sleeves 35 and 35 constitute projections, which peripherally slidably engage the annular race (see the number 17 of FIGS. 1 and 2) on the side of the pump housing to define the protrusion of the vane 11 during rotation.

Figure 16:
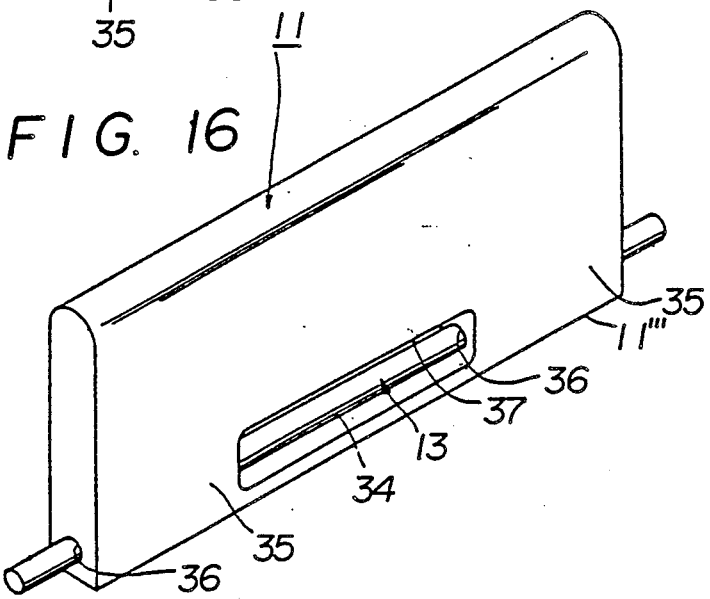
FIG. 16 is a perspective view of the vane of the pump belonging to the same Type 2.
Figure 17:
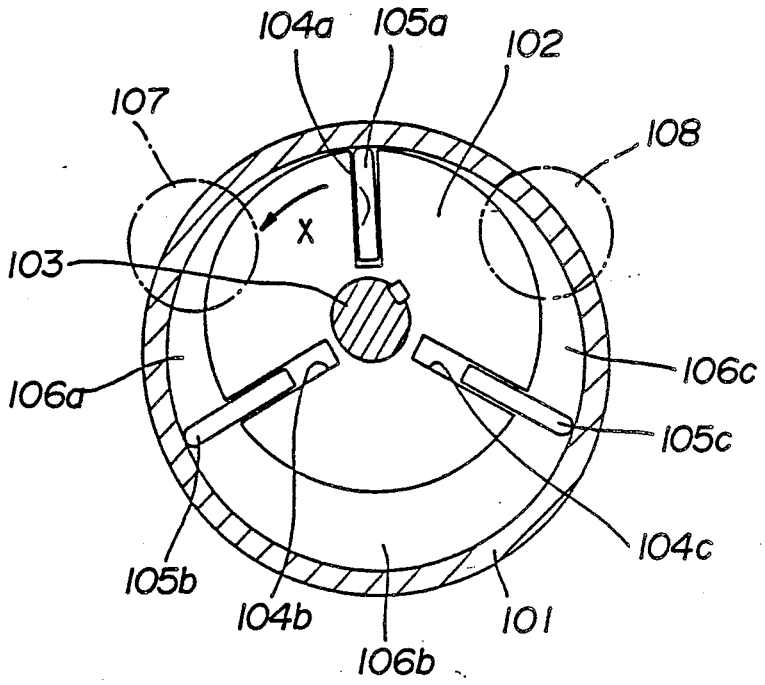
FIG. 17 PRIOR ART
FIG. 17 is a sectional view showing one example of a vane pump according to the prior art.

Next, in FIG. 16, a window portion 37 is provided in the vicinity of the base 11''' in place of the cutout 33 shown in FIG. 15 to form a cavity 34, and other structures of FIG. 16 are similar to those shown in FIG. 15.

In the FIGS. 15 and 16 structure, local stress concentration hardly occurs between the vane 11 which tends to be moved out by the centrifugal force during rotation and the pin 13 to define it, as previously mentioned. Since each of the mounting holes 36 is short, their working may be carried out easily and with high accuracy, and the weight of the vane 11 is reduced through the portion of the cavity 34.

It is to be noted that the cavity 34 is subsequently filled with resins or the like whereby the fixing strength between the vane 11 and the pin 13 may be further increased.

As described above, according to the above-described vane, the fixing strength between the projections (pins) provided on the opposite ends of the vane and the vane is high to increase the supporting force against the protrusion of the vane during rotation, and therefore, high speed rotation becomes possible to enhance the feed force of the fluid under pressure. Accordingly, the pump may be miniaturized and reduced in weight. Moreoever, the mounting holes through which the pins extend are divided by the cavity and shortened, and therefore drilling of the mounting holes may be carried out easily and with high accuracy, thus providing a great practical effect.

While we have described the preferred embodiment of the present invention, it will be obvious that various other modifications can be made without departing from the principle of the present invention. Accordingly, it is desired that all the modifications that may substantially obtain the effect of the present invention through the use of the structure substantially identical with or corresponding to the present invention are included in the scope of the present invention.

This application incorporates herein the disclosures of U.S. Ser. No. 075,006, filed July 17, 1987; U.S. Ser. No. 110,919 filed Oct. 21, 1987; U.S. Ser. No. 113,568 filed Oct. 26, 1987; and U.S. Ser. No. 115,677 filed Oct. 30, 1987.

What we claim is:

1. A rotary machine comprising a housing means having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projections means projecting from said longitudinal ends, said housing means having limiting means receiving said projection means and operable to limit the extent of outward radial movement of said vane means from its respective vane slot to preclude sliding contact between said vane means and said inner peripheral surface of said rotor chamber, said vane means comprising a vane body having a radially outer end and a radially inner end, said radially outer end being juxtaposed to said inner peripheral surface of said rotor chamber, said vane body having longitudinal ends which correspond to said longitudinal ends of said vane means, said vane body having planar parallel side walls extending from said radially outer end to said radially inner end and also extending between said longitudinal ends of said vane body, a reinforcement means embedded in said vane body, said reinforcement means comprising a web part and a projection-supporting part joined to said web part, said web part being generally planar and being embedded in said vane body between and parallel to said vane body side walls, said projection-supporting part being embedded within said vane body and supporting said projection means which project from said longitudinal ends of said vane body.

2. A rotary machine according to claim 1 wherein said projection means comprises pin means, said pin means being mounted on said projection-supporting part of said reinforcement means.

3. A rotary machine according to claim 2 wherein said projection-supporting part has a cylindrical portion disposed about at least a portion of said pin means.

4. A rotary machine according to claim 3 further comprising weld means providing a weld connection between said cylindrical portion and said pin means.

5. A rotary machine according to claim 1 wherein said projection means comprises pin means, and weld means providing a weld attachment between said pin means and said projection-supporting part.

6. A rotary machine according to claim 1 wherein said web part and said projection-supporting part have common planar side walls such that said web part and said projection-supporting part have the same thickness, said projection-supporting part having recesses, said projection means comprising pins mounted in said recesses.

7. A rotary machine according to claim 1 wherein said projection means comprises pin means integrally formed with said reinforcement means.

8. A rotary machine according to claim 7 wherein said pin means and said reinforcement means comprise an integrally formed casting.

9. A rotary machine according to claim 7 wherein said pin means and said reinforcement means comprise an integrally formed forging.

10. A rotary machine according to claim 1 wherein said web part has a plurality of through openings, said vane body having vane body parts disposed in said openings.

11. A rotary machine according to claim 10 wherein said projection means comprises pin means, said projection-supporting part comprising welding means extending into at least one of said openings to provide a weld connection between said pin means and said projection-supporting part.

12. A rotary machine according to claim 1 wherein said projection-supporting part comprises a tubular body, said projection means comprising pin means mounted in said tubular body.

13. A rotary machine according to claim 12 further comprising welding means providing a weld attachment between said tubular body and said pin means.

14. A rotary machine according to claim 12 wherein said tubular body extends substantially between said longitudinal ends of said vane body, said pin means being a single pin having longitudinal ends which project from said longitudinal ends of said vane body.

15. A rotary machine according to claim 1 wherein said projection-supporting part comprises two spaced and axially aligned tubular bodies, said pin means comprising one pin mounted in one of said tubular bodies and another pin mounted in the other of said tubular bodies.

16. A rotary machine according to claim 1 wherein said vane body is made of a resin material.

17. A rotary machine according to claim 1 wherein said vane body is made of a carbon material.

18. A rotary machine according to claim 1 wherein said reinforcing means is made of metal.

19. A rotary machine comprising a housing means having a rotor chamber, said rotor chamber having an inner peripheral surface, a rotor means rotatably mounted in said rotor chamber, said rotor means having an axis of rotation, said inner peripheral surface having a central axis which is eccentrically disposed relative to said axis of rotation of said rotor means, said rotor means having a plurality of generally radially disposed vane slots, a plurality of vane means slidably mounted in said vane slots and operable to define variable volume chambers for said fluid as said rotor means rotates and said vane means move generally radially in and out of said vane slots, said vane means having longitudinal ends, projection means projecting from said longitudinal ends, said housing means having limiting means receiving said projection means and operable to limit the extent of outward radial movement of said vane means from its respective vane slot to preclude sliding contact between said vane means and said inner peripheral surface of said rotor chamber, said vane means comprising a vane means comprising a vane body and a reinforcing means, said reinforcing means having a generally U-shaped part having spaced legs extending from a base, said reinforcing means having a web connected to said spaced legs, said vane body having a radially inner section disposed on opposite sides of said web and extending between said legs, said vane body having a radially outer section extending radially outwardly of said legs and radially outwardly of said web, said radially outer section of said vane body having a longitudinal length substantially equal to the longitudinal distance between the outer longitudinal ends of said legs, said radially inner section of said vane body having transverse thickness substantially equal to the transverse thickness of said legs and to the transverse thickness of said base, said radially outer section of said vane body being integral with said radially inner section and having a transverse thickness equal to said transverse thickness of said radially inner section, said projection means comprising pins extending from said legs.

20. A rotary machine according to claim 19 wherein said radially outer section of said vane body has a radially outer terminating end juxtaposed to said inner peripheral surface of said rotor chamber.

21. A rotary machine according to claim 19 wherein said vane slots have a bottom end, said base being juxtaposed to said bottom end.

* * * * *